US005638617A

United States Patent [19]

Bélanger et al.

[11] Patent Number: 5,638,617

[45] Date of Patent: Jun. 17, 1997

[54] SNOWPLOW EQUIPMENT FOR ROAD VEHICLE

[75] Inventors: Germain Bélanger, St-Germain-de-Grantham; Pierre Larivière, Roxton Falls, both of Canada

[73] Assignee: Her Majesty the Queen in right of Canada, as represented by the Ministry of Transport of the Government of Quebec, Quebec, Canada

[21] Appl. No.: 594,259

[22] Filed: Jan. 30, 1996

[51] Int. Cl.[6] ..... E01H 5/04

[52] U.S. Cl. ..... 37/270; 37/232; 37/233

[58] Field of Search ..... 37/232, 233, 231, 37/235, 266, 270, 283, 117.5, 216; 172/822, 823

[56] References Cited

U.S. PATENT DOCUMENTS

| | | | |
|---|---|---|---|
| 3,465,456 | 9/1969 | Meyer | 37/233 |
| 3,477,149 | 11/1969 | Wagner | 37/233 |
| 3,808,714 | 5/1974 | Reissinger et al. | 37/233 |
| 4,215,496 | 8/1980 | Wehr | 37/232 X |
| 4,259,794 | 4/1981 | Rath | 37/232 X |
| 4,288,932 | 9/1981 | Küper | 37/233 |
| 4,347,677 | 9/1982 | Küper | 37/233 |
| 4,590,694 | 5/1986 | Block | 37/233 |
| 5,136,795 | 8/1992 | Rosenberg | 37/232 X |
| 5,477,600 | 12/1995 | Houle et al. | 37/233 X |

*Primary Examiner*—Terry Lee Melius
*Assistant Examiner*—Robert Pezzuto
*Attorney, Agent, or Firm*—Merchant, Gould, Smith, Edell, Welter & Schmidt, P.A.

[57] ABSTRACT

Snowplow equipment is described which is adapted to be mounted to a road vehicle wherein composite materials are used in the construction of all load bearing structural components of the equipment. Each component is lightweight and has inherent damping characteristics to reduce the transmission of road surface vibrations to the vehicle and to reduce power consumption. Essentially, each component is formed of a sandwich construction of wood and of laminates of glass fibers and resin.

11 Claims, 7 Drawing Sheets

SNOWPLOW EQUIPMENT FOR ROAD VEHICLE

FIELD OF THE INVENTION

The present invention pertains to a snowplow equipment to be mounted to a road vehicle and principally used for the winter maintenance of highways; more particularly, the invention is concerned with the construction and design of an all composite front plow, side wing and thrust frame, forming part of the snowplow equipment.

BACKGROUND OF THE INVENTION

The design and manufacturing of highway snowplow equipment have not gone through many modifications or improvements since their commercial production. Even with a consistent weight problem, snowplow equipment designs have always called for steel materials to meet strength and rigidity requirements. In some cases, in order to reduce weight, steel snow plows have been provided with openings or their lower blades have been made of plastics material.

Up to now, the conventional snowplow equipment used on highways has faced operational problems and design defects affecting fuel consumption, handling, power consumption and chassis dynamics. For example, a typical snowplow equipment presently used by the Quebec Ministry of Transportation has the following weight problems: it represents one extra metric ton on the total weight of the vehicle and one and a half extra metric tons on the front axle of the vehicle. Since snowplows operate under a variety of hazardous conditions, such as wet and icy roads, the extra weight on the front axle (with the plow up)generates serious handling and driving conditions and, even more when the salt-sand spreader used with the road vehicle is almost empty.

Therefore, the multi-purpose snow removal vehicle operating on a highway suffer problems of overload on front axles and are subjected to high levels of constraints so that important modifications must be brought to the front chassis, to the front axle and to the tires.

The excessive weight and high rigidity of snowplow equipments, made of steel, have therefore resulted in requiring reinforcement and over-dimensioning of the front chassis, of the front axle and of the tires. These modifications are partly due to the energy which is transmitted by the snowplow equipment. The only mechanism which is presently available to reduce the impact energy when the wear blade of the snowplow contacts a severe obstacle consists of a triangular pivot device coupled to a coil spring, the function of which is to deform upon impact. However, it has been regularly observed that such pivot device is not satisfactorily functional because of its considerable inertia or, in other words, its slow reaction response. Therefore, in response to an impact due to high speed, the device is slow to react, which results in a major portion of the impact energy to be directly transmitted from the front plow to the vehicle chassis before the latter has had time to react thereby causing, in some cases, important damages to one or more of the structural components of the vehicle.

Therefore, the construction of present snow removal equipments is totally rigid, using steel, the density of which is in the order of 7.8. There results, in addition to a heavy weight equipment, an excess weight on the front axle as well as a reduction on the rear axle, the function of which is to provide traction. This traction problem is amplified more particularly in the case of a snow covered, or icy, road. The snowplow vehicle is therefore rendered less efficient by this reduction of weight on the rear axle, this being amplified by an overload on the front axle, the function of which is to direct the vehicle.

Presently, many snowplow vehicles are used for two purposes: one is snow removal, the other is abrasive spreading. In the case where the vehicle is equipped with an abrasive spreader, it is mainly used in conditions of highly icy surfaces, which renders its maneuver or driving very risky when conditions of axle weight distribution described above exist. The important cantilever configuration of a snow removal equipment, made of steel, at the front of the vehicle further reduces its maneuverability and traction when the spreader is empty. Furthermore, weight reduction on a snowplow equipment becomes an important factor to satisfy the regulations concerning loads on road surfaces while rendering the vehicle more maneuverable and safer.

Presently, a complete snowplow equipment weights about 3,450 Kg which is distributed as follows: 1,050 Kg on the snowplow, 700 Kg on the side wing and 1,700 Kg on the harness and thrust chassis of the plow and the side wing.

When the snow plow and the side wing are in the up position, the results is the following; an additional weight of 2460 Kg on the front axle and a reduction of 530 Kg on the rear axle. This weight distribution conditions prevail more particularly when the snow plow vehicle spreads salt and sand on icy road conditions when there is no snow removal.

The use of steel for the construction of these components automatically results in it being subjected to rust or corrosion, which is a chemical attack phenomenon particular to the environment in which the equipment is used. The snow plow and the side wing are also exposed to abrasion due to cumulative sand dispersed in snow. The abrasion effect inside the front and side plow blades results in scratching paint and exposing fresh steel to corrosion in a continuous process. The most exposed surface to abrasion is localized in the lower portion of the blades where the sand-loaded snow is compressed, accumulated and cast off to the side. A regular and periodical maintenance is therefore required to ensure a minimum of longevity and important periodic operations of sand-blasting, of protection coating and of painting are needed. Hence, important maintenance costs and a constant wear of the equipment due to corrosion are factors affecting present snowplow equipment.

OBJECTS AND STATEMENT OF THE INVENTION

An object of the present invention is therefore to provide a snowplow equipment which is made of a material lighter than steel, which is totally resistant to corrosion by the use of polymeric composite materials and which is relatively flexible so that it may absorb and resist to important road impacts between the front plow and the road obstacles.

The reduction of weight is obtained by the replacement of steel (density of 7.8) by a composite material, essentially constituted of continuous glass fibers and of thermoset resin, the density of which is 1.7 when glass fibers and thermoset resin are combined in weight rates of 50/50.

The fact that the center of gravity of the front plow in the up position and the thrust frame is situated in a cantilevered way with respect to the front axle of the vehicle shows that the weight of these components plays an important role in the distribution of the vehicle weight on the ground (front and rear axle). By greatly reducing the weight of these components, there results a reduction of the load on the front axle, an increase of the load of the rear axle for improved traction, the elimination of the need to reinforce the front chassis of the truck and, finally, the use of tires having conventional width as well as of front axles having conventional sizes.

The present invention therefore relates to a snowplow which comprises an elongated moldboard having a frontwardly curved profile extending between a lower horizontal edge and an upper inclined edge, the moldboard being formed of composite materials in a sandwich arrangement including a front wall, a rear wall and an inner core; the core consisting of wood and each wall consisting of a laminate of glass fibers and thermoset resin.

This snowplow construction is basically the same whether for the front snowplow or for the side wing.

The present invention also relates to a thrust chassis for mounting the front snowplow to the chassis of the vehicle, which comprises: a laminate body having a triangular shape including three side walls and rounded corners; each side wall having an inner core of hardwood encapsulated in a laminate of glass fibers and resin; each corner having an inner core of urethane encapsulated in a laminate of glass fibers and resin; and a plurality of horizontally spaced spring means mounted to one of the side walls; each spring means consisting of an elliptical spring encapsulated in urethane.

The use of a composite material having a base of polymeric resin totally eliminates the corrosion problem which is particular to metal, such as steel, when in the presence of corrosive substances, such as the salt mixed with snow. The choice of a resin, such as polyester, vinyl ester or epoxy, brings this chemical resistance at a high level in a corrosive medium such as is the case with snowplow equipments.

Due to their construction in a composite material, these components (front plow, thrust frame and side wing) have a flexibility which is more or less dependent on the composition of the laminates used.

In the case of the thrust frame, the function of which being to absorb and distribute the impact energy resulting from sudden obstacles met by the plow, the triangular configuration of the frame combined with the incorporation of composite springs results in an assembly capable of elastically absorbing, i.e. without permanent deformation, road impacts as well as vibrations due to irregularities in the road surfaces.

Due to the closed geometry of the triangular frame, constituted by a laminate of glass fibers and resin inside which a core is encapsulated, two types of core have been devised: one is a core of hardwood in the straight sections of the frame; the other is a core of high density urethane resin in the corners of the frame. Thus, the three corners of the triangular frame have a urethane core whereas the three longitudinal sides have a hardwood core. The connection of these two types of cores is achieved by a jointing of the tenon-sleeve type so that the continuity of a semi-rigid assembly may be maintained.

The triangular frame has therefore a monocoque structure so that it can uniformly react when subjected to a deformation resulting from external forces caused by the thrust of snow and/or road obstacles. This monocoque construction also acts as a shock absorber in order to minimize the constraints applied on the vehicle chassis.

The triangular frame is serially combined to an ensemble of elliptical springs encapsulated in urethane resin; there results a double effect of energy take-up and absorbing. The elliptical springs have a dual purpose: first, to absorb energy and to distribute the deformation depending on the resultant of the forces applied to the plow whether at the center or at the extremities thereof; second, to enable a partial pivotment of the plow in the case where the wear blade contacts a sudden obstacle or when fully loaded with heavy snow.

The use of urethane resin to encapsulate the composite springs provides the springs with a damping effect to deformation and to substantially modify or increase the spring constant. Furthermore, the presence of a urethane elastomer between the triangular beam and the elliptical springs and the plow eliminates problems of friction or abrasion between the surfaces resulting from the vibration constraints of the plow. The presence of urethane around the elliptical springs reduces the localized constraints of torsion created by the angle (oblique) of thrust of the plow. When the plow is partially or totally filled with snow, the resultant force causes a lateral deformation of the springs, which deformation is uniformly redistributed by the presence of the urethane elastomer around the elliptical springs. The elliptical springs, being encapsulated in urethane resin, are therefore capable of absorbing deformations whether in a perpendicular axis or at an oblique angle; and, this is achieved without generating localized stresses which could result in a premature breaking of the component.

The flexibility of the assembly of the thrust frame is further obtained by the presence of two compensatory arms which are also made of a composite material and which have a spring function. As a result of their particular configuration, these two arms serve to retain the plow in position while enabling it, in case of impact or rearward pivotment, or before reacting, to absorb and distribute the resultant energy. Their effect is combined to that of the elliptical springs, situated at the base of the plow, and the resultant of all this assembly enables the plow to react in a flexible manner to the constraints, or external forces, particular to snowplowing.

The configurations of the two compensatory arms are different due to their location with respect to their capability of pushing the plow. The load or maximum force resulting from the snow thrust being situated on the side of the exit of the plow, the arm situated near the exit plow side has a greater dimension than that situated at the opposite side. The connections of the arms to the triangular frame and to the plow require the assistance of plates, molded in urethane in order to eliminate premature wear of the contact surfaces which are caused by road vibrations. Furthermore, the presence of these elastomeric plates enable to reduce the concentrated effect of the tightening forces of the anchorage bolts by uniformly redistributing the contact pressure between the pieces in presence with one another.

The presence of a urethane elastomer between the connections or contact surfaces of the various structural components enables a safe assembly against fatigue by uniformly distributing the tightening forces of the connecting bolts and by eliminating all possible localized wear due to road vibrations.

The construction of the front plow component is determined to provide a secondary feature, that is to also participate to the criteria of flexibility and energy absorption. As a result of its geometry as well as of its rigidity, the plow is constructed so as to absorb energy generated by snow removal as well as impact phenomena.

The use of a sandwich-type structure for the moldboard with a longitudinal reinforcement at its base (where the wear blade is located) provides an assembly which is relatively rigid while still permitting elastic deformations, which deformations are clearly superior to those permitted by steel when the plow is subject to high constraints of deflexion, torsion and compression.

The core used in the moldboard section of the plow is balsa wood which is a material having a density of about 0.15, while the core constituting the longitudinal reinforcement at the base of the moldboard is hardwood timber, such as maple or birch, having a density of 0.7 approximately.

The spring connections at the base of the plow, in other words along the axis of its connection to the thrust frame, enables the plow to absorb, to deform and to transfer the deformation energy to the thrust frame in a proportional distribution manner whether the resultant of the forces generated on the plow are perpendicular or oblique with respect to the central axis of the vehicle.

The equilibrium of the plow in a vertical plane is obtained by the two arms which are connected to the upper part of the moldboard. Whether the amount of accumulated and displaced snow is more or less important on the moldboard, the two compensatory arms as well as the elliptical springs mounted at the base of the moldboard have a proportional reaction.

Therefore, depending on the amount of snow which is accumulated and displaced by the plow, the latter can be slightly and elastically deformed along its longitudinal axis thereby providing a better distribution of the loads on each of the connections, i.e., the elliptical springs and the two arms. The flexibility of the plow is therefore an important criterion for the operation of the energy absorbing system constituted by the arms, the springs and the triangular frame.

Other objects and further scope of applicability of the present invention will become apparent from the detailed description given hereinafter. It should be understood, however, that this detailed description, while indicating preferred embodiments of the invention, is given by way of illustration only, since various changes and modifications within the spirit and scope of the invention will become apparent to those skilled in the art.

IN THE DRAWINGS

DESCRIPTION OF PREFERRED EMBODIMENTS

Figure 1:
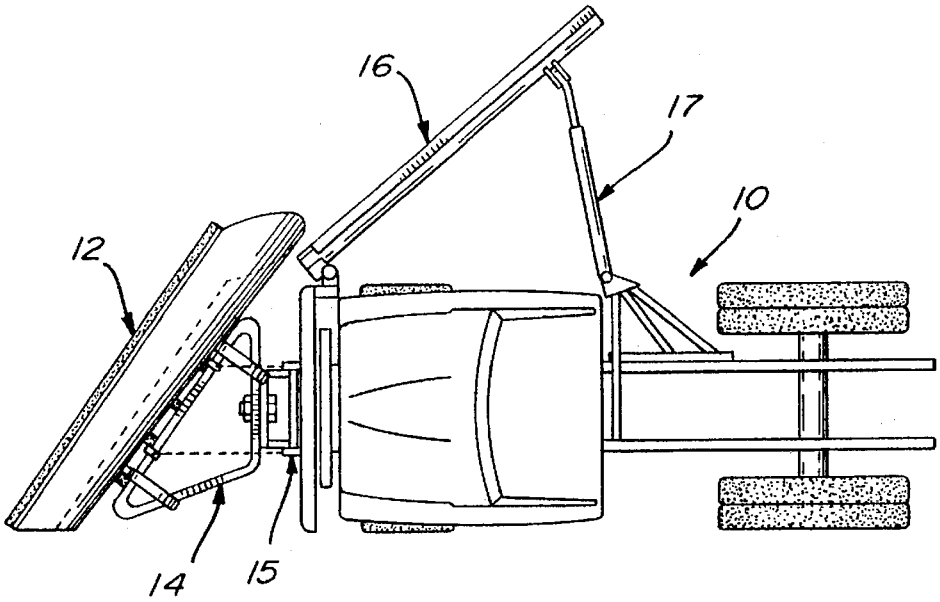
FIG. 1 is a schematic top view of a snow removal vehicle equipped with a front plow, side wing and thrust frame made in accordance with the present invention.

Referring to FIG. 1, there is shown a snowplow vehicle, generally denoted 10, equipped with components made in accordance with the present invention: a front plow 12, a thrust frame 14 and a side wing 16. While the front plow is shown mounted to the thrust frame, the latter is shown mounted to the front of the road vehicle by means of a harness mechanism 15; the side wing is mounted to the side of the vehicle by means of a pushing arm structure 17. Both the harness mechanism and the pushing arm structure are conventional and will not be described in detail.

Figure 2:
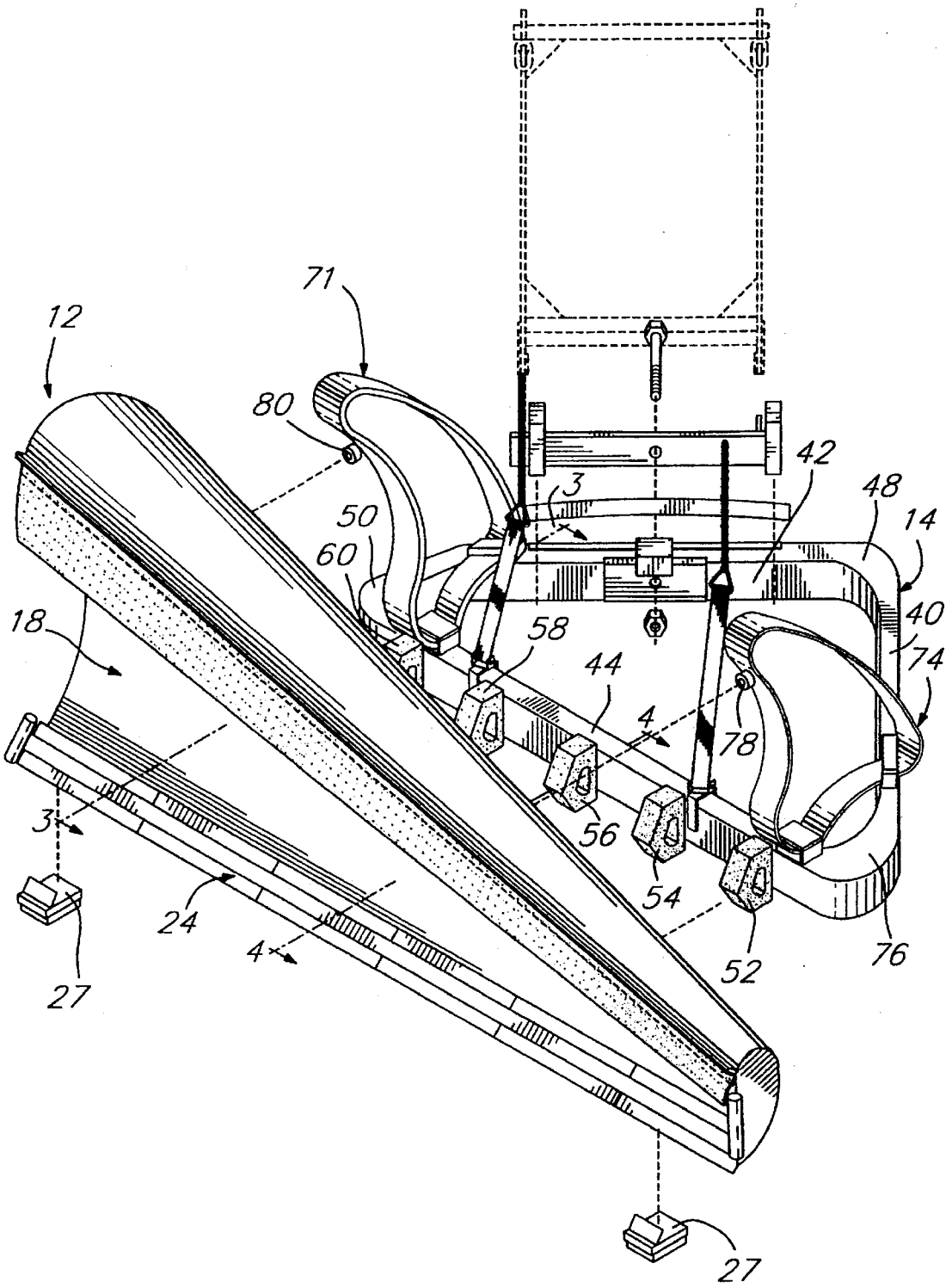
FIG. 2 is an exploded view showing the front plow and the thrust beam.
Figure 3:
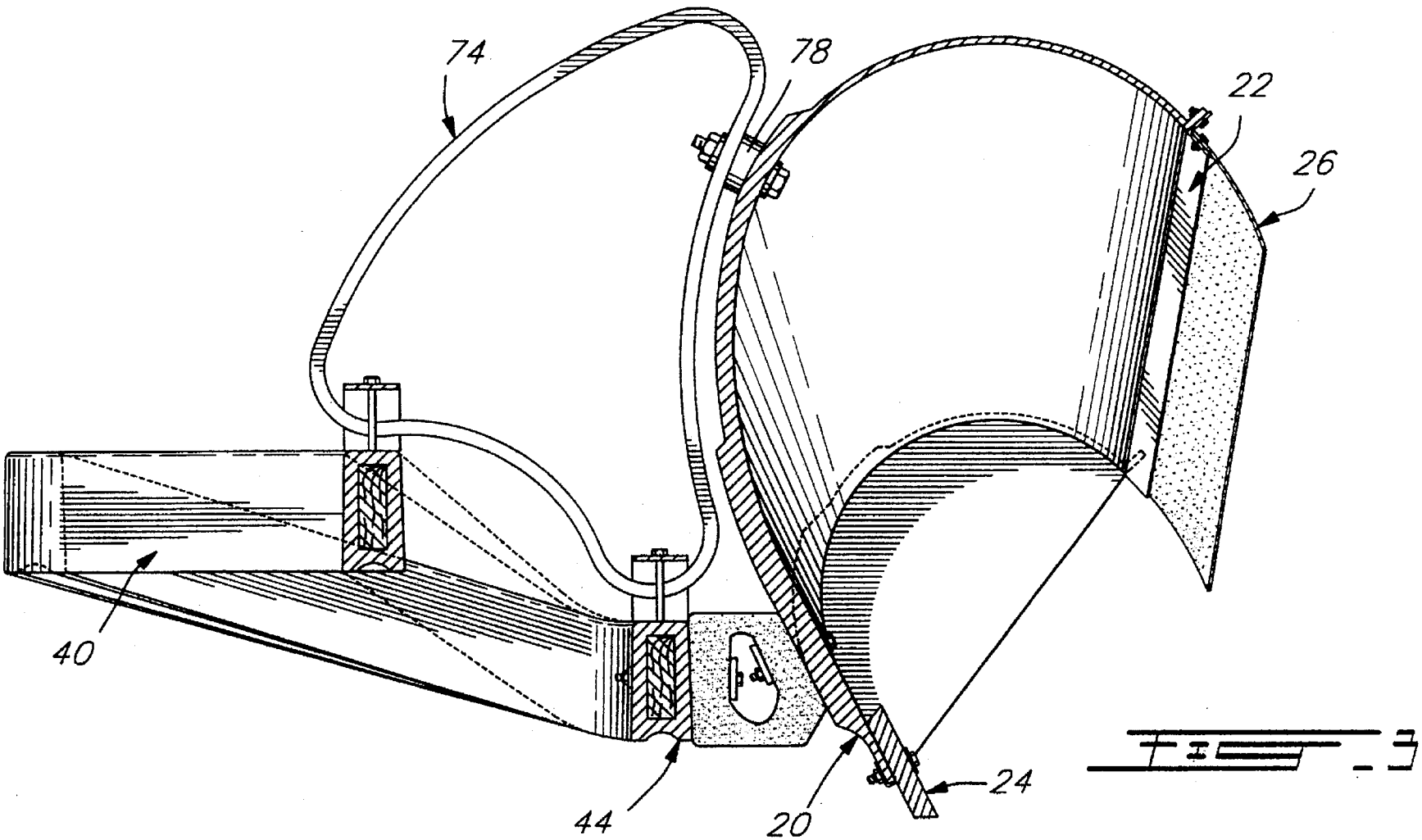
FIG. 3 is cross sectional view taken along lines 3—3 of FIG. 2.
Figure 7:
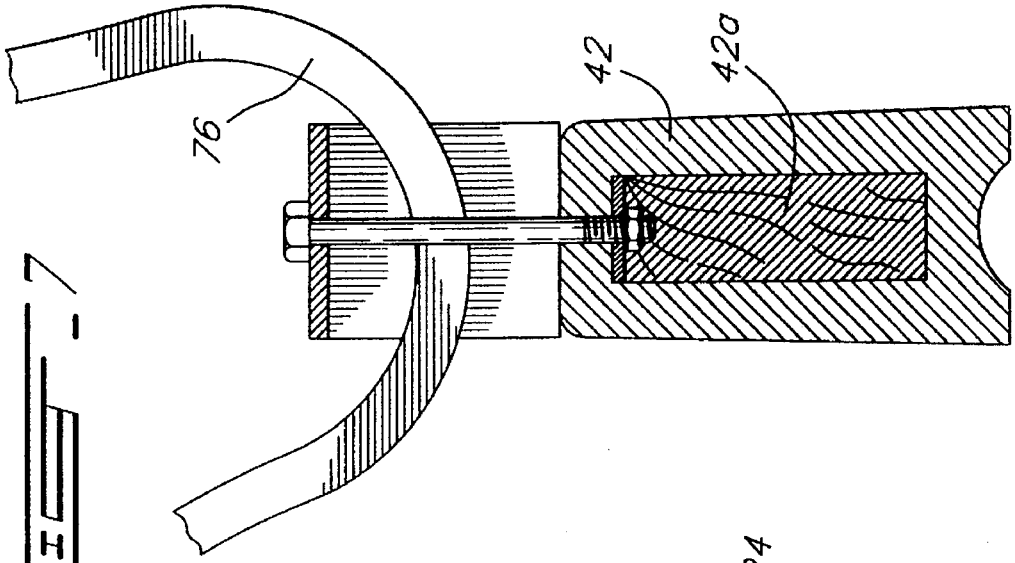
FIG. 7 is a cross sectional view taken along lines 7—7 of FIG. 6.
Figure 4:
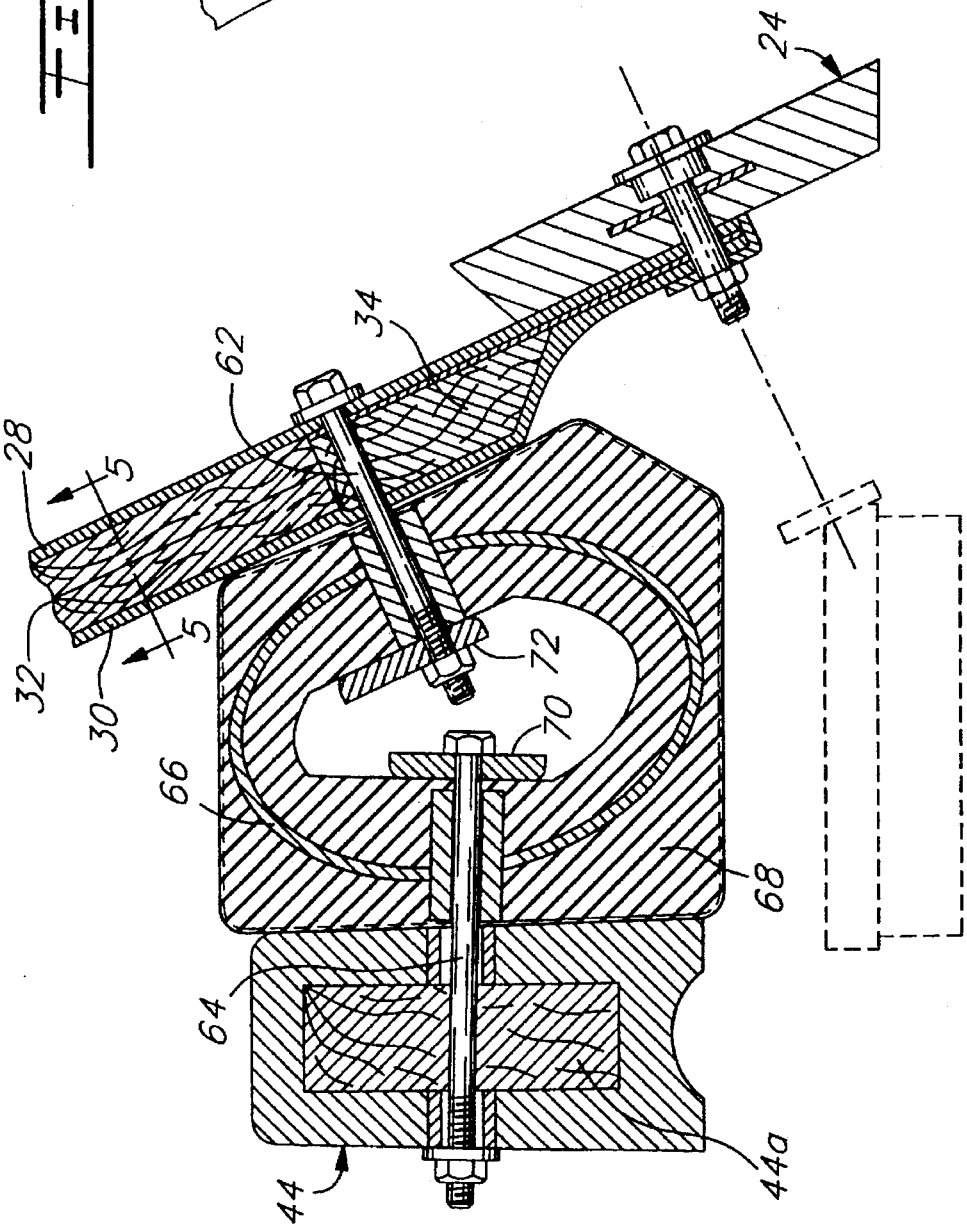
FIG. 4 is a cross sectional view taken along lines 4–4 of FIG. 2.

Referring to FIGS. 2, 3 and 4, the front plow 12 comprises an elongated moldboard 18 having a frontwardly curved profile extending between a lower horizontal edge 20 and an upper inclined edge 22. A wear blade 24 is secured to the lower edge 20 while a snow deflector 26 is fixedly mounted to the upper edge 22. A pair of conventional skates 27 is fixed to the base of the front plow.

Figure 5:
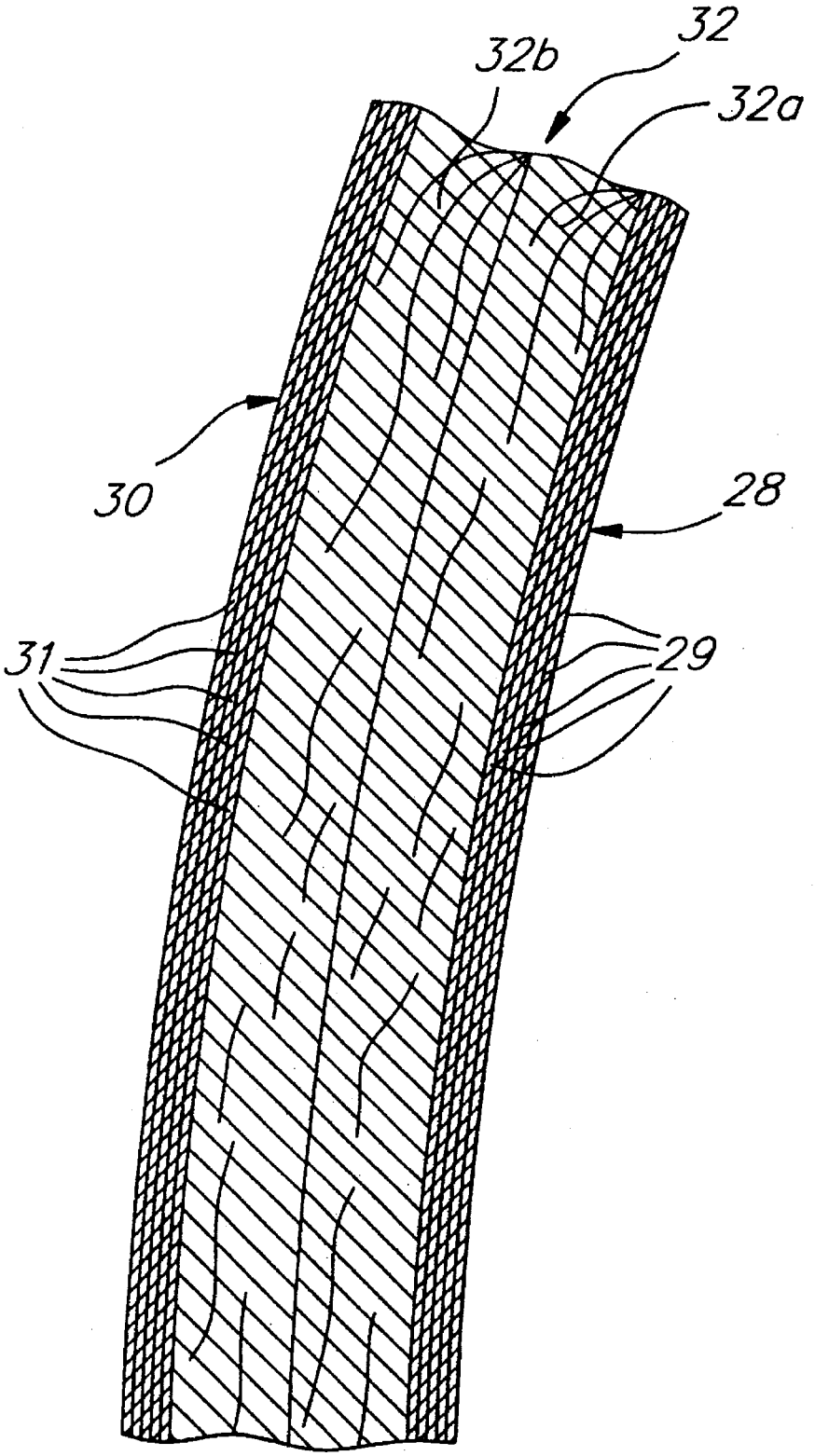
FIG. 5 is an enlarged cross sectional view taken along lines 5—5 of FIG. 4.
Figure 6:
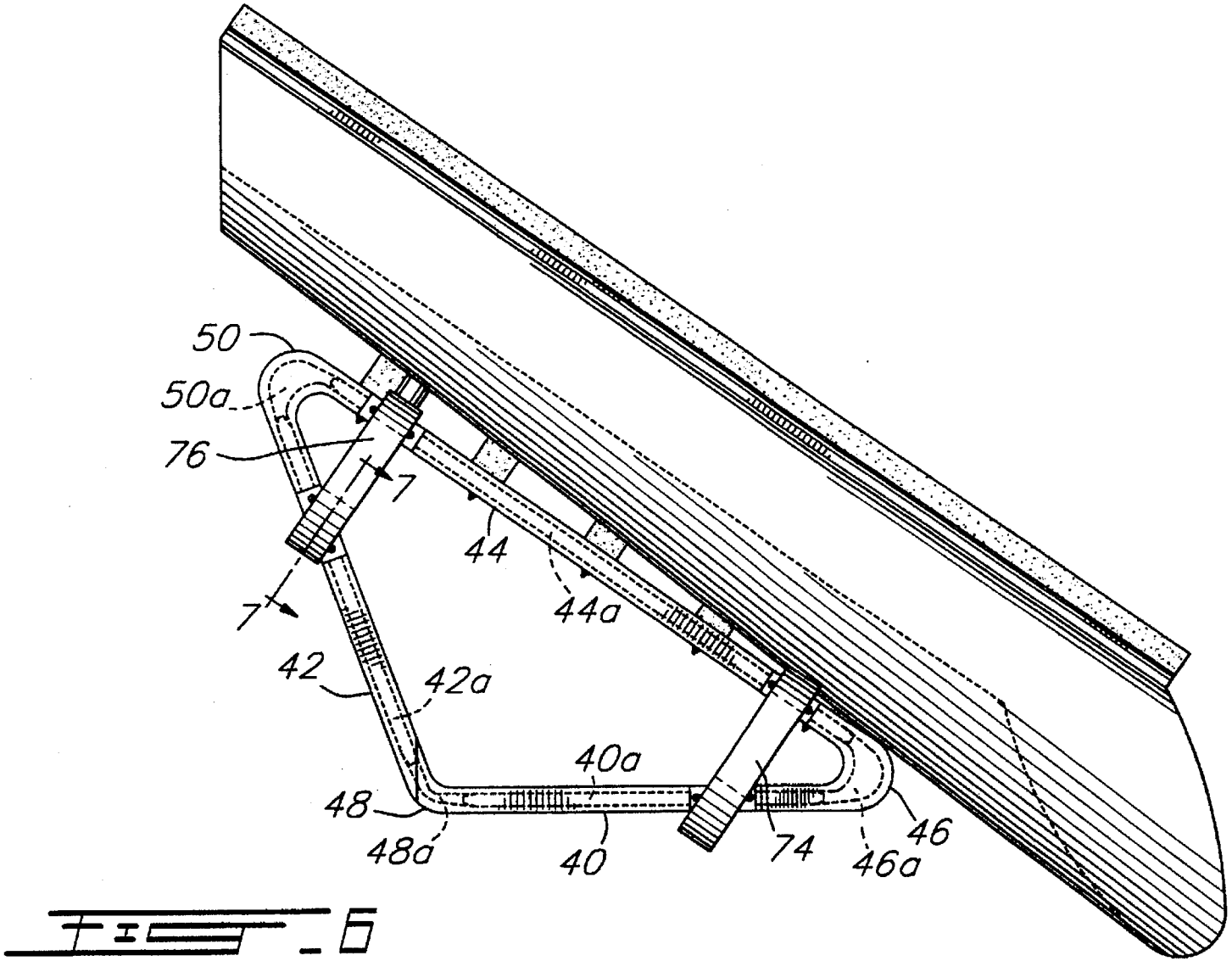
FIG. 6 is a top plan view of the assembly of the plow and thrust frame.

As can be seen in FIGS. 4 and 5, the moldboard is formed of composite materials in a sandwich arrangement defining a front wall 28, a rear wall 30 and an inner core 32. The front and rear walls 28 and 30 consist of laminates 29, 31 of continuous filaments of glass fibers and a resin matrix of thermoset type while the core consists of wood (two layers being shown as 32*a*, 32*b*).

The moldboard represents, a major portion of the front snowplow and its rigidity is obtained by this sandwich construction of relatively uniform thickness. Preferably, the wood core is balsa wood and its function is to provide an important part of the overall thickness thus increasing rigidity for a fixed amount of glass fibers laminate and thermoset resin.

The preferred form of balsa wood is Contourkore which is a core blanket formed of end-grain balsa block attached to an open-weaved fiberglass cloth or scrim. It is able to conform to a contour surface.

Forming the lower part of the moldboard, a reinforcement extends longitudinally; here the core 34 consists of a hardwood timber providing the required resistance. Preferably, this hardwood is maple or birch having the most uniform longitudinal fiber orientation and modulus of elasticity close to 2,000,000 psi (13,000 mega Pascals).

The structural resistance of the front and rear walls of the moldboard is obtained by means of a combination, or an orderly superposition, of various types of continuous glass fibers tissues, having orientation angles varying between 0° and 180°; these tissues are entirely impregnated with thermoset resin, such as vinyl ester.

The low weight of the moldboard is obtained by the balsa wood 32 and by the hardwood 34 which are materials having respective densities which are lower than that of the laminates of glass fibers/vinyl ester.

While maintaining a certain flexibility which is particular to composite materials, maximum rigidity is achieved by means of the two structural walls spaced by the core of balsa wood, thus providing an important increase of the inertia moment of the cross-section of the moldboard without, however, increasing proportionally the resulting weight (maximum rigidity increase for a minimum weight increase).

The moldboard is made by a molding process which consists in a manual operation of superposing layers of tissues of glass fibers impregnated with vinyl ester resin. The possibility of orienting the continuous filaments in one or more principal axes permits optimizing the required thickness and obtaining an optimal specific strength.

The thrust frame 14 has triangular shape with three longitudinal sides 40, 42 and 44 and round corners 76, 48 and 50 (see FIG. 2). The thrust frame consists of a continuous laminate of glass fibers tissues, the fibers being oriented in different predetermined directions which enable to meet the induced constraints of torsion, flexion and shearing as well as tension and compression. This laminate is thus continuous with rounded corners in order to minimize constraint concentrations.

The triangular and monocoque geometry of the thrust chassis offers a secure behaviour in case of extreme deformation because it favours the buckling phenomena of the three longitudinal sides of the triangular structure instead of a localized transversal shearing of only one longitudinal side.

The triangular beam has a sandwich construction and it comprises a core constituted by two materials, i.e. a hardwood timber core 40*a*, 42*a*, 44*a* in respective side wall sections 40, 42 and 44 and a urethane core 46*a*, 48*a*, 50*a* in respective rounded corners 46, 48 and 50. The mechanical connection of hardwood to urethane is obtained by a sleeve-type jointing of the urethane at the extremity of the timber; this enables an efficient transfer of constraints between the two materials when the triangular beam is subjected to relatively important deformations.

Referring to FIG. 2, to the side wall 44 of the beam is mounted a series of spring members 52, 54, 56, 58 and 60. As shown in FIG. 4, these members are connected by means of bolts 62 to the lower part of the moldboard, more particularly to the timber wood reinforcement 34. The spring members are also connected to the side wall 44 of the beam by means of bolts 64 which extend through the timber wood 44*a*. Each spring member consists of an elliptical spring 66 which is formed of unidirectional filaments which are circumferentially oriented and wound in a manner that they generate a balanced laminate of glass fibers and thermoset resin. The ratio of fiber to resin as well as the total thickness of the laminate determine the resultant spring constant. In the present embodiment where five spring members are used, it has been found that a minimum of three springs are always active whether the applied load is decentered towards the left or the right.

The elliptical spring is generally and, in great part, subject to an oblique load, torsion constraints, which are not negligible, must be compensated by the addition of a urethane envelope 68 around the elliptical spring. This envelope serves to redistribute more uniformly the induced constraints (torsion and flexion) in the elliptical laminate while conferring to it an additional absorption effect. Furthermore, this envelope of urethane renders more uniform the contact pressure between the three components i.e. the thrust frame, the elliptical springs and the snowplow, while eliminating wear problems that may result from relative movement between the contacting surfaces. The anchoring of the elliptical springs to the contiguous components is achieved by a simple fastening of metallic plates 70 and 72 against the urethane envelope. During the pouring of the urethane around the elliptical springs, the inclined planes of the contacting surfaces are reproduced accurately thus permitting a simple and efficient assembly.

A pair of compensatory arms 71 and 74 are mounted to the triangular beam and have respective projections 78 and 80 which are adapted to be mounted to the moldboard. These arms are fabricated in substantially the same way as that of the elliptical springs without, however, being encapsulated in urethane resin. The relative thickness of each arm is established as a function of the potential distribution of loads on the front of the snowplow. The dual function (resistance to forward and to rearward movements) is also related to the geometry of the shape of the arms which must be fixedly anchored to the thrust chassis as described above.

The arms are therefore conceived to work in a cantilever manner, in parallel with the five elliptical springs. As soon as the moldboard is subjected to rotation in the vertical plane, there first occurs a localized deformation of the urethane envelope on the elliptical springs and, thereafter, a cantilever deflection of the arms follows.

There is therefore a relation between the spring constant of the arms and that of the elliptical springs, which constant may be adjusted in accordance with the rate of glass fibers to resin and to the thickness and width of each of the components.

Figure 10:
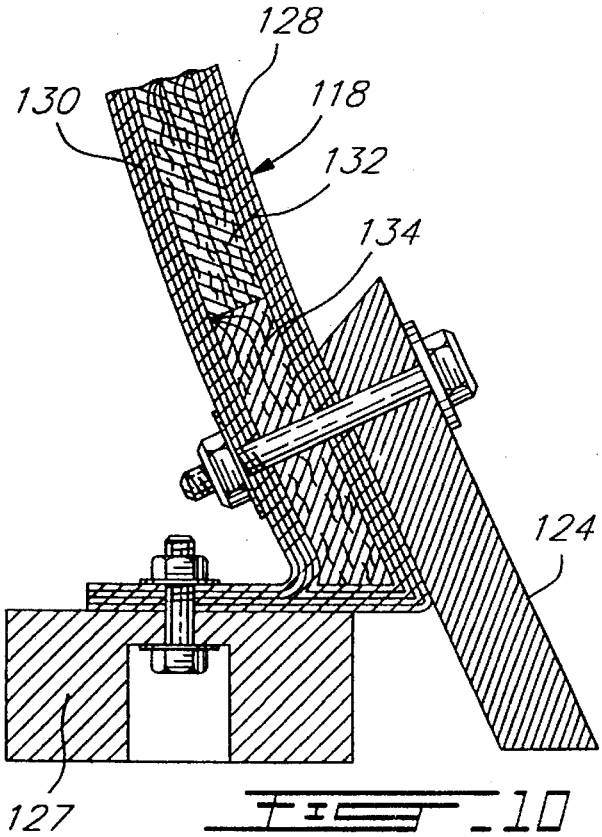
FIG. 10 is an enlarged cross-section of the lower part of the side wing.
Figure 9:
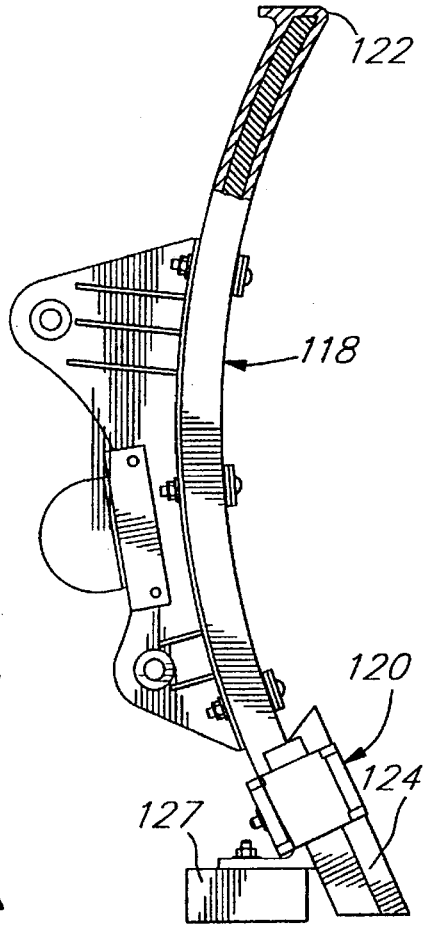
FIG. 9 is a side elevation, partly sectional, of the side wing.
Figure 8:
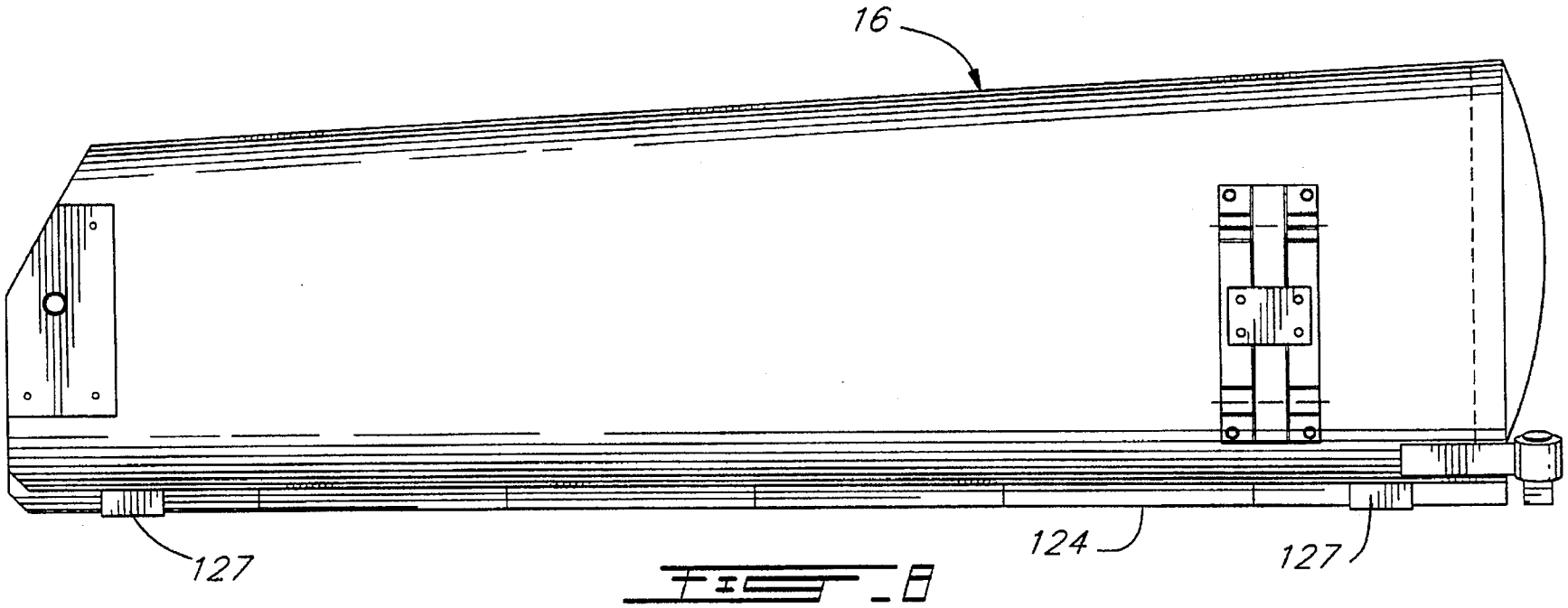
FIG. 8 is a rear elevation of the side wing.

Referring to FIGS. 8, 9 and 10, the composition of the side wing 16 is of the same type as the moldboard 12. It comprises an elongated moldboard 118 having a frontwardly curved profile extending between a lower horizontal edge 120 and upper inclined edge 122. A wear blade 124 is secured to the lower edge 120 while a pair of conventional skates 127 is fixed to the base of the moldboard. The board of the side wing is a sandwich structure requiring a core of balsa wood and hardwood. The balsa core 132 is in the curving portion of the wing whereas the hardwood timber 134 is located at the base of the wing where a wear blade 124 is mounted. The laminates 128 and 130 of the front and rear walls are obtained from the same type of tissues utilized for the moldboard, except that their combination is different. An anti-abrasive gel coat can be applied on the inner to reduce or eliminate the abrasion effect resulting from sand content in the snow.

The relative importance of the flexion and torsion constraints resulting from the loading diagram, combined to the type of support of the side wing results in that the orientation of the fibers is different from that of the front plow. The reduction of the weight of the wing results principally from the use of a sandwich type structure, the thickness of which has the effect to increase radically the module of rigidity of the wing assembly. The molding of an integral flange at the upper edge as well as at the lower edge increases the resistance in flexion and in torsion of the wing.

Although the invention has been described above with respect with one specific form, it will be evident to a person skilled in the art that it may be modified and refined in various ways. For example, although the snow equipment was described above as being mounted to a road vehicle, it is noted that such vehicle may be track-propelled instead of wheel driven. It is therefore wished to have it understood that the present invention should not be limited in scope, except by the terms of the following claims in which the term "snowplow" designates the front plow and the side wing described above.

The embodiments of the invention in which an exclusive property or privilege is claimed are defined as follows:

1. A snowplow comprising: an elongated moldboard having a frontwardly curved profile extending between a lower horizontal edge and an upper inclined edge, said moldboard being formed of composite materials in a sandwich arrangement including a front wall, a rear wall and an inner core; said core consisting of wood and each said wall consisting of a laminate of glass fibers and thermoset resin; wherein said wood is balsa and wherein said resin is epoxy vinyl ester.

2. A snowplow as defined in claim 1, wherein said laminate of glass fibers consists of multi-layers of glass fibers tissues having orientation angles varying between 0° and 180° and being impregnated with said resin.

3. A snowplow as defined in claim 1, wherein said moldboard has, on the front wall thereof, an elongated anti-abrasive surface of gelcoat.

4. A snowplow as defined in claim 3, wherein said gelcoat comprises a thermoset resin base including fine particles selected from the group consisting of silicon carbide, pulverized silica and a mixture of silicon carbide and pulverized silica.

5. A snowplow as defined in claim 1, wherein said moldboard includes, adjacent said lower edge thereof, a longitudinally oriented reinforcement of hardwood between said laminate of glass fibers and resin.

6. A snowplow as defined in claim 1, further comprising anchoring means extending in the upper and lower parts of said rear wall and traversing said moldboard for securing snowplow equipment thereto.

7. A thrust chassis for mounting a snowplow to a vehicle chassis, comprising:

a laminate body having a triangular shape including three side walls and three rounded corners, each of said side walls having an inner core of hardwood encapsulated in a laminate of glass fibers and resin each of said corners having an inner core of urethane encapsulated in a laminate of glass fibers and resin and a plurality of horizontally spaced spring means mounted to one of said side walls, each of said spring means comprising an elliptical spring encapsulated in urethane.

8. A thrust chassis as defined in claim 7, wherein each said spring is formed of unidirectional filaments oriented circumferentially and wound to form a laminate of glass fibers and resin.

9. A thrust chassis as defined in claim 7, wherein said hardwood core and said urethane core are jointed adjacent said corners to allow a uniform and gradual stress transfer between said cores and said side walls when said chassis is subjected to high deformation.

10. A thrust chassis as defined in claim 7, further comprising anchoring plates affixed to two side walls for connecting compensatory arms adapted to be secured to said snowplow.

11. A thrust chassis as defined in claim 10, wherein said plates are positioned at an interface between said hardwood core and laminates composing the side wall.

* * * * *